United States Patent [19]

Ijiri et al.

[11] Patent Number: 4,914,941

[45] Date of Patent: Apr. 10, 1990

[54] POWER TOOL FOR CRIMPING TERMINAL ELEMENTS FOR CONNECTING LEAD WIRES THERETO

[75] Inventors: Tomoya Ijiri, Kyoto; Koji Soeda, Takatsuki, both of Japan

[73] Assignee: Omron Tateisi Electronics Co., Kyoto, Japan

[21] Appl. No.: 166,029

[22] Filed: Mar. 9, 1988

[30] Foreign Application Priority Data

Mar. 14, 1987 [JP] Japan ..... 62-59897

[51] Int. Cl.[4] ..... B21J 9/18

[52] U.S. Cl. ..... 72/449; 72/450; 72/410; 29/750

[58] Field of Search ..... 72/449, 450, 453.15, 72/453.16, 410, 409, 407, 452; 29/750, 751, 758, 243.56

[56] References Cited

U.S. PATENT DOCUMENTS

| | | | |
|---|---|---|---|
| 3,066,304 | 12/1962 | Wantland | 72/407 |
| 3,091,276 | 5/1963 | Aquitton | 72/449 |
| 3,397,567 | 8/1968 | Klingler | 72/449 |
| 3,834,214 | 9/1974 | Kralowetz | 72/452 |
| 4,107,973 | 8/1978 | Smejkal et al. | 72/450 |
| 4,475,374 | 10/1984 | Sakai et al. | 72/407 |

FOREIGN PATENT DOCUMENTS

| | | | |
|---|---|---|---|
| 1001012 | 11/1976 | Canada | 72/452 |
| 1268573 | 5/1968 | Fed. Rep. of Germany | 72/452 |
| 1472954 | 2/1967 | France | 72/449 |

*Primary Examiner*—David Jones

*Attorney, Agent, or Firm*—Stevens, Davis, Miller & Mosher

[57] ABSTRACT

Disclosed in a powered crimping tool for crimping a metallic terminal upon a wire lead for accomplishing both electric and mechanical connection therebetween, comprising: a casing having a die member attached thereto; an electric motor having an output shaft; a reduction unit for reducing the rotational speed of the output shaft of the electric motor, having a rotating output end; and a mechanism such as a slider crank mechanism for converting the rotary motion of the output end of the reduction unit into a rectilinear motion of a crimping punch member which cooperates with the die member. The casing which is shaped an elongated box accommodates a die member and a punch member at an longitudinal end thereof and an electric motor at the other longitudinal end thereof, a reduction unit being disposed therebetween. This powered crimping tool can be made light enough to be used on a desk top or held by the hand of the user.

7 Claims, 2 Drawing Sheets

POWER TOOL FOR CRIMPING TERMINAL ELEMENTS FOR CONNECTING LEAD WIRES THERETO

TECHNICAL BACKGROUND

The present invention relates to a powered tool for crimping terminal elements such as terminal pieces of connectors, terminal lugs, terminal tangs and other metallic members to lead wires and other electric conductors for accomplishing both electric and mechanical connection therebetween.

BACKGROUND OF THE INVENTION

Conventionally, wire leads are connected to terminal elements such as terminal pieces of connectors and terminal lugs by means of hand operated crimping tools which are provided with a punch and a die which are brought together by way of a pair of scissor-like handles adapted to be gripped by the operator. According to such conventional hand operated tools, the fatigue of the operators is so great that an improvement of the crimping tools has been desired. On the other hand, according to conventional powered crimping tools, the overall size is so great that they can not be carried to desired locations and the cost is also high.

BRIEF SUMMARY OF THE INVENTION

In view of such problems of the prior art, a primary object of the present invention is to provide a powered tool for crimping terminal element for connecting lead wire thereto which is compact and does not require any accessory facilities for its operation.

A second object of the present invention is to provide a powered crimping tool which can drastically reduce the fatigue of the operator.

According to the present invention, these and other objects of the present invention can be accomplished by providing a powered crimping tool for crimping a metallic terminal upon a wire lead for accomplishing both electric and mechanical connection therebetween, comprising: a casing having a die member attached thereto; an electric motor having an output shaft; a reduction unit for reducing the rotational speed of the output shaft of the electric motor, having a rotating output end; and means for converting the rotary motion of the output end of the reduction unit into a rectilinear motion of a crimping punch member which cooperates with the die member.

Preferably, the means for converting the rotary motion of the output end of the reduction unit into the rectilinear motion of the punch member comprises a slider crank mechanism having a slider member connected to the crimping punch member, and a connecting rod pivotally connected to both the output end of the reduction unit and the slider member.

The casing for accommodating the whole assembly may be conveniently shaped as an elongated box so that the die member and the punch member may be accommodated in an longitudinal end portion thereof while the electric motor may be accommodated in the other longitudinal end portion thereof, with the reduction unit being disposed therebetween.

If the longitudinal end is upwardly inclined in relation with the main part of the casing, the crimping tool may be placed on a flat surface and the crimping work can be accomplished involving very little fatigue.

According to a preferred embodiment of the present invention the die member is adjustable along the direction of the motion of the punch member so as to allow variation of an effective stroke of the punch member. Thus, since the die member is stationary, it can be made adjustable with a relatively simple mechanism and the wide range of terminal elements can be crimped with the same powered crimping tool.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
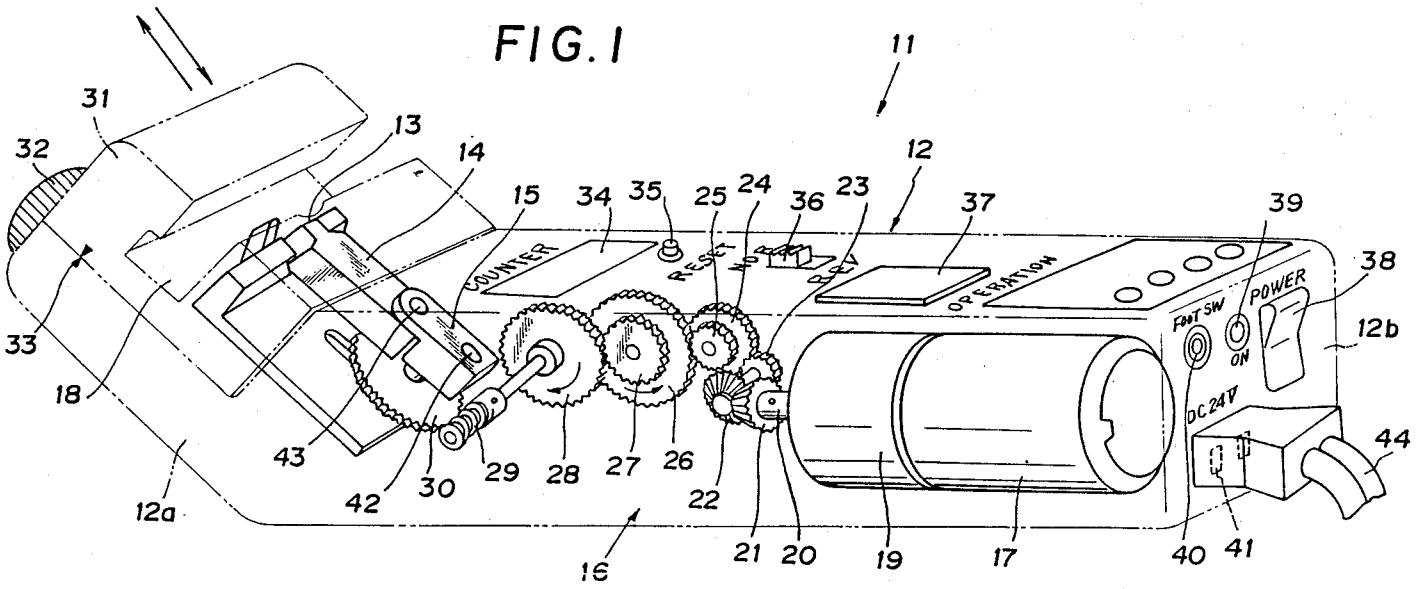
FIG. 1 is a see-through perspective view of a first embodiment of the powered crimping tool according to the present invention.

FIG. 1 shows an embodiment of the crimping powered tool according to the present invention. This powered crimping tool 11 comprises a casing 12 which is generally provided with the shape of an elongated box and is additionally provided with an upwardly inclined end 12*a*. The bottom surface of the casing 1 is generally flat and permits the powered crimping tool 11 to be placed flat on a desk surface or the like. The inclined end 12*a* incorporates a die unit 31 which is adjustable as described hereinafter. The lateral slot 18 provided in the die unit 31 receives a slider jig (not shown in the drawings) which is adapted to the particular kind of terminal elements intended to be crimped.

The casing 12 accommodates therein the punch member 14, a connecting rod 15 pivotally connected to the proximal end of the punch member 14, a reduction unit 16 having an output end pivoted to the other end of the connecting rod and a small electric motor 17. As shown in FIG. 1, the electric motor 17 has a longitudinal line which is parallel with the longitudinal line of the casing 12.

The electric motor 17 is provided with an output shaft 20, a brake unit 19 associated with the output shaft 20 for controlling the motion thereof and a conical (first) gear 21 fixedly attached to the output shaft 20.

The reduction unit 16 comprises a conical (second) gear 22 which meshes with the first gear 21 and is fixedly attached to a rotary shaft, a third gear 23 which is fixedly attached to the rotary shaft common to the second gear 22, a fourth gear 24 which meshes with the third gear 23 and is fixedly attached to a rotary shaft, a fifth gear 25 which is fixedly attached to the rotary shaft common to the fourth gear 24, a sixth gear 26 which meshes with the fifth gear 25 and is fixedly attached to a rotary shaft, a seventh gear 27 which is fixedly attached to the rotary shaft common to the sixth gear 26, a eighth gear 28 which meshes with the seventh gear 27 and is fixedly attached to a rotary shaft, a worm (ninth gear) 29 which is fixedly attached to the rotary shaft common to the eighth gear 28, and a tenth gear 30 which meshes with the worm (ninth gear) 29. This tenth gear 30 serves as the output end of this reduction unit 16.

The other end of the connecting rod 15 is pivoted to an eccentric point of the tenth gear 30 by way of a pivot pin 42 which extends parallel to the rotary shaft of the tenth gear 30. The other end of the connecting rod 15 is pivotally connected to the proximal end of the punch member 14, as mentioned previously, by way of a pivot pin 43. Thus, when the electric motor 17 is driven and the tenth gear 30 rotates at a reduced speed as determined by the reduction unit 16, the punch member 14 reciprocates into and out of the lateral slot 18 with the connecting rod 15 serving as the connecting rod and the punch member 14 as the slider of a classical slider-crank mechanism.

When the punch member 14 projects into the slot 18, the free end 13 of the punch member 14 presses upon the terminal element and the wire lead which are not shown in the drawings and crimps the terminal element upon the wire lead. When the power to the electric motor 17 is not turned on, the punch member 14 stays inside the casing 12 without projecting into the slot 18.

The optimum stroke of the punch 14 varies depending on the diameter of the wire lead and the kind of the terminal piece. Therefore, the stroke of the punch member 14 is made adjustable in the present embodiment. The knob 32 provided on the free end of the inclined end 12a of the casing 12 is connected to a screw rod 45 (FIG. 3) which is rotatively supported by the casing 12 and threads with a nut 46 attached to the die unit 31 in such a manner that the die unit 31 slides along the inclined surface of the inclined end 12*a* away and towards the main part of the casing 12 as the knob 32 is turned clockwise and counter-clockwise direction, respectively. The marks 33 provided in the areas of the inclined end 12 and the die unit 31 adjacent to the parting line therebetween indicates the relatively position between the die unit 31 and the inclined end 12*a*.

The upper surface of the main part of the casing 12 is provided with a count display 34 for showing the number of the crimping work which has been performed, a reset button 35 for resetting the count display, a control switch 36 for reversing the direction of the rotation of the motor 17 and a start push button switch 37 for starting each cycle of the action of the punch member 14. Additionally, the end surface 12*b* of the casing 12 opposite to the inclined end 12*a* is provided with a power switch 38, an indicator lamp 39 for indicating the power is on, a jack 40 for connecting a foot switch to the powered tool and a receptacle 41 for connecting a power cord.

Various parts of the powered tool, such as the casing 12, the connecting rod 15 and the gears 21 through 30, are made of synthetic resin to reduce the overall weight. As a result, this powered crimping tool is highly portable and easy to handle.

Now the action of this crimping tool is described in the following.

First of all, a terminal element and a wire lead are placed in the slot 18 by way of a slider attachment (not shown in the drawings) and the start push button switch 37 is pressed. The electric motor 17 is powered and turns one end of the connecting rod 14 by way of the final gear 30 of the reduction unit 16. As a result, the punch member 14 is pushed into the slot 18 and the free end 13 thereof crimps the terminal element upon the lead wire in cooperation with a die member.

Figure 2:
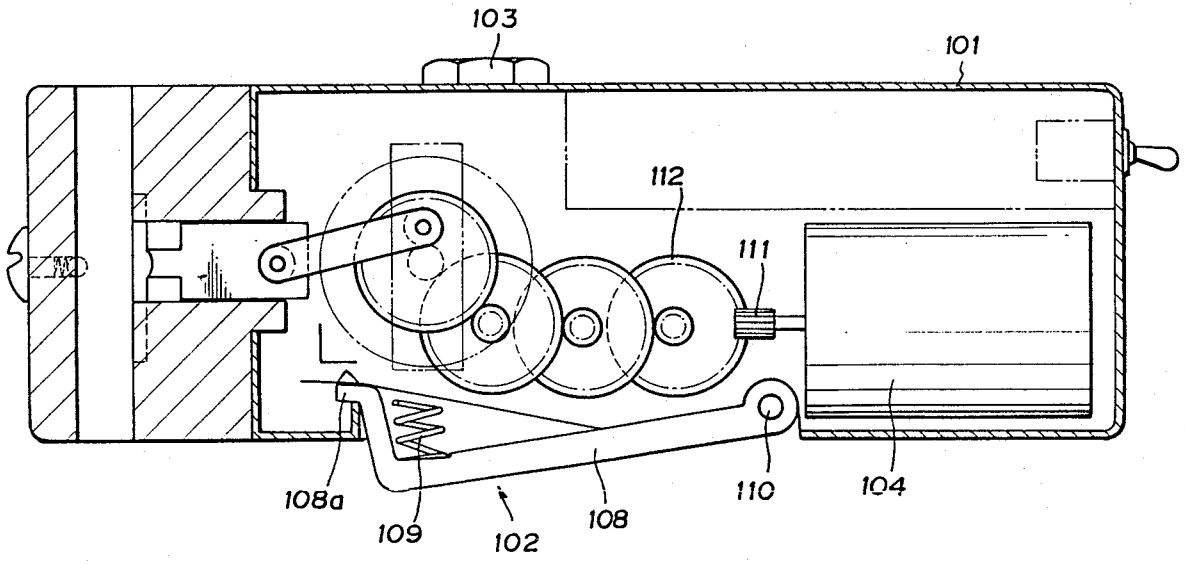
FIG. 2 is a sectional side view of a second embodiment of the present invention, and, FIG. 3 is a sectional side view of a portion of FIG. 1.

FIG. 2 shows a second embodiment of the present invention. This embodiment is adapted to be gripped by the user and is provided with a start switch 102 consisting of a lever member 108 pivoted at one end thereof to the casing 101 by way of a pivot pin 110 and urged outwardly by a compression coil spring 109. An extension 108*a* of the lever member 108 limits the extent to which the lever member 108 swings outwardly. Additionally, the first gear 111 which is fixedly attached to the output shaft of the electric motor 104 consists of a pinion gear 111 and the second gear consists of a crown gear 112 which meshes with the pinion gear 111. Numeral 103 denotes a mount for attaching this powered crimping tool to a stand or the like.

In other respects, the second embodiment is similar to the first embodiment. Because this embodiment is adapted to be held by the hand of the user, the die unit 31 may be either inclined with respect to the main part of the casing or, alternatively, not inclined at all by extending straight from the main part of the casing.

Thus, the present invention provides a compact and light-weight crimping tool which is easy to use. This powered tool may be held by the hand of the user or may be placed on top of a flat surface as desired.

Although the present invention has been shown and described with reference to the preferred embodiments thereof, it should not be considered as limited thereby. Various possible modifications and alterations could be conceived of by one skilled in the art to any particular embodiment, without departing from the spirit and scope of the present invention.

What we claim is:

1. A powered crimping tool for crimping a metallic terminal upon a wire lead for accomplishing both electric and mechanical connection therebetween, comprising:

a casing having a die member attached thereto, said casing having a first portion extending in a first longitudinal direction and a second end portion extending from an end of said first portion, said second end portion being upwardly inclined relative to said first portion;

an electric motor locating in said casing having an output shaft;

a reduction unit located in said casing and operationally connected to said electric motor for reducing the rotational speed of the output shaft of the electric motor, said reduction unit having a rotating output end;

means located in said casing and operationally connected to said reduction unit for converting the rotary motion of the output end of the reduction unit into a rectilinear motion; and, a crimping punch member operationally connected to said converting means, said crimping punch member cooperating with the die member, said die member being attached to said upwardly inclined second end portion of said casing and said punch member being provided in said upwardly inclined second end portion of said casing, whereby an operator can easily observe a crimping operation conducted between said die member and punch member.

2. A powered crimping tool as defined in claim 1, wherein the means for converting the rotary motion of the output end of the reduction unit into the rectilinear motion of the punch member comprises a connecting member connected to the crimping punch member, and a connecting rod pivotally connected to both the output end of the reduction unit and the connecting member.

3. A powered crimping tool as defined in claim 2, wherein a lateral slot is defined in the upper surface of the inclined second end portion for placing a die member therein, the punch member being disposed adjacent to the slot to move in and out of the slot as it undergoes the reciprocating motion.

4. A powered crimping tool as defined in claim 3, wherein the electric motor is accommodated in said first portion of the casing.

5. A powered crimping tool as defined in claim 4, wherein the die member is adjustable along the direction of the motion of the punch member so as to allow variation of an effective stroke of the punch member.

6. A powered crimping tool as defined in claim 2, wherein the first portion and second end portion of said casing are shaped as elongated boxes with said second end portion having a lateral slot defined in the upper surface thereof for placing a die member therein, the punch member being disposed adjacent to the slot to move in and out of the slot as it undergoes reciprocating motion and the electric motor being accommodated in said frist portion of the casing with the reduction unit being disposed between the motor and punch member.

7. A powered crimping tool as defined in claim 6, wherein the die member is adjustable along a longitudinal direction of said second end portion of the casing so as to allow variation of an effective stroke of the punch member.

* * * * *